US011244614B2

(12) United States Patent
He et al.

(10) Patent No.: US 11,244,614 B2
(45) Date of Patent: Feb. 8, 2022

(54) PIXEL DRIVER CIRCUIT, DISPLAY DEVICE AND PIXEL DRIVING METHOD

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Jing He, Beijing (CN); Chunmiao Tang, Beijing (CN); Ting Li, Beijing (CN); Zhonglin Cao, Beijing (CN); Yuanjie Xu, Beijing (CN); Pengcheng Zang, Beijing (CN); Yao Li, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/044,794

(22) PCT Filed: Mar. 13, 2020

(86) PCT No.: PCT/CN2020/079345
§ 371 (c)(1),
(2) Date: Oct. 1, 2020

(87) PCT Pub. No.: WO2020/207193
PCT Pub. Date: Oct. 15, 2020

(65) Prior Publication Data

US 2021/0166624 A1 Jun. 3, 2021

(30) Foreign Application Priority Data

Apr. 10, 2019 (CN) ..... 201910286660.3

(51) Int. Cl.
*G09G 3/3233* (2016.01)

(52) U.S. Cl.
CPC ..... *G09G 3/3233* (2013.01); *G09G 2300/043* (2013.01); *G09G 2300/0819* (2013.01); *G09G 2320/0233* (2013.01); *G09G 2330/02* (2013.01)

(58) Field of Classification Search
CPC ..... G09G 3/3233; G09G 2300/0819; G09G 2330/02; G09G 2320/0233; G09G 2300/043
See application file for complete search history.

(56) References Cited

U.S. PATENT DOCUMENTS 10,825,399 B2 * 11/2020 Chen ..... G09G 3/3291
2005/0068271 A1 3/2005 Lo
(Continued)

FOREIGN PATENT DOCUMENTS

CN 1601594 A 3/2005
CN 101609839 A 12/2009
(Continued)

OTHER PUBLICATIONS

International Search Report and Written Opinion dated Jun. 15, 2020, for PCT/CN2020/079345.
(Continued)

*Primary Examiner* — Jeff Piziali
(74) *Attorney, Agent, or Firm* — Dinsmore & Shohl LLP

(57) ABSTRACT

A pixel driver circuit, a display device, and a pixel driving method are provided. The pixel driver circuit includes a driving module for providing a drive current to a pixel; a threshold voltage compensation module for providing threshold voltage compensation for the driving module; and a first switch module, a second switch module, a third switch module, and a fourth switch module, the terminals of each
(Continued)

of which are electrically connected to various components in a particular manner. According to the embodiments of the present application, the threshold voltage of the driving transistor can be effectively compensated.

8 Claims, 6 Drawing Sheets

(56) References Cited

U.S. PATENT DOCUMENTS

| | | | | |
|---|---|---|---|---|
| 2009/0309516 | A1 | 12/2009 | Kim | |
| 2010/0164847 | A1* | 7/2010 | Lee | G09G 3/3233 345/77 |
| 2012/0013597 | A1 | 1/2012 | Han | |
| 2012/0139890 | A1* | 6/2012 | Choi | G09G 3/3233 345/212 |
| 2015/0221252 | A1* | 8/2015 | Qing | G09G 3/3291 345/76 |
| 2016/0125808 | A1 | 5/2016 | Hsu et al. | |
| 2016/0210892 | A1 | 7/2016 | Ohara et al. | |
| 2016/0275869 | A1* | 9/2016 | Hwang | G09G 3/3258 |
| 2017/0053594 | A1 | 2/2017 | Kimura | |
| 2018/0137815 | A1* | 5/2018 | Cheng | H01L 29/78 |
| 2018/0137816 | A1* | 5/2018 | Cheng | G09G 3/30 |
| 2018/0268757 | A1 | 9/2018 | Chen et al. | |
| 2018/0357963 | A1 | 12/2018 | Gai et al. | |
| 2018/0374417 | A1 | 12/2018 | Yang et al. | |
| 2018/0374418 | A1* | 12/2018 | Chen | G09G 3/3233 |
| 2019/0073955 | A1 | 3/2019 | Zou et al. | |

FOREIGN PATENT DOCUMENTS

| | | | |
|---|---|---|---|
| CN | 102339586 | A | 2/2012 |
| CN | 104036732 | A | 9/2014 |
| CN | 104200779 | A | 12/2014 |
| CN | 104409042 | A | 3/2015 |
| CN | 104464635 | A | 3/2015 |
| CN | 105659311 | A | 6/2016 |
| CN | 205282057 | U | 6/2016 |
| CN | 106486063 | A | 3/2017 |
| CN | 107358920 | A | 11/2017 |
| CN | 108597448 | A | 9/2018 |
| CN | 108877669 | A | 11/2018 |
| CN | 109509433 | A | 3/2019 |
| CN | 109903722 | A | 6/2019 |
| KR | 20050097336 | A | 10/2005 |
| KR | 20070071524 | A | 7/2007 |

OTHER PUBLICATIONS

First Office Action dated Mar. 24, 2020, relating to CN Patent Application No. 201910286660.3.

* cited by examiner

PIXEL DRIVER CIRCUIT, DISPLAY DEVICE AND PIXEL DRIVING METHOD

CROSS REFERENCES TO RELATED APPLICATIONS

The present application is a U.S. National Stage under 35 U.S.C. § 371 of International Application No. PCT/CN2020/079345 filed on Mar. 13, 2020, which claims priority to Chinese Patent Application No. 201910286660.3 filed on Apr. 10, 2019, the entirety of which are incorporated herein by reference.

TECHNICAL FIELD

The present application relates to the field of display technology, specifically, to a pixel driver circuit, a display device, and a pixel driving method.

BACKGROUND

Organic Light-Emitting Diode (OLED) as a current-type light-emitting device has been increasingly used in new generation display devices.

A basic OLED driver circuit is a type of 2T1C. The 2T1C OLED driver circuit includes two thin film transistors (TFTs) and one capacitor (C). The value of the driving current (that is, the current flowing through the driving transistor) can determine the brightness produced by the OLED device, and the magnitude of the driving current is related to the threshold voltage of the driving transistor.

Due to the process factors of the transistors, the characteristics of the transistors in respective regions of the display device are different, that is, the threshold voltages of the driving transistors are different. Therefore, when multiple display units in different regions input with the same data signals, the driving transistors at the display units provide different driving currents to the corresponding OLED devices, resulting in non-uniform brightness display of the display device.

SUMMARY

The present application provides a pixel driving circuit, a display device, and a pixel driving method. According to the embodiments of the present application, the technical problem of uneven display brightness of OLED device caused by uneven driving currents due to the difference in the threshold voltages of the driving transistors in the prior art can be solved.

According to a first aspect of the present disclosure, a pixel driver circuit is provided according to embodiments of the present application. The pixel driver circuit comprises: a driving module, a threshold voltage compensation module, and a first switch module, a second switch module, a third switch module, and a fourth switch module;

wherein, first to fifth terminals of the threshold voltage compensation module are electrically connected to a first node, a second node, a data signal source, a third node, and a second signal source, respectively;

first to third terminals of the driving module are electrically connected to the first node, the third node, and the second node, respectively;

first to third terminals of the first switch module are electrically connected to a power supply, the first node, and a first signal source, respectively;

first to third terminals of the second switch module are electrically connected to the third node, a light emitting element, and a fourth node, respectively;

first to third terminals of the third switch module are electrically connected to a fifth signal source, the second node, and a third signal source, respectively;

first to third terminals of the fourth switch module are electrically connected to the fifth signal source, the fourth node, and a fourth signal source, respectively.

According to a second aspect of the present disclosure, a display device is provided that comprises a pixel driver circuit according to any the embodiments of the present application.

According to a third aspect of the present disclosure, a pixel driving method is provided for the pixel driver circuit according to any embodiments of the present disclosure, comprising:

in a reset phase, turning the fourth switch module on to output a second level signal received through the first terminal thereof to the fourth node;

in a drive reset phase, turning the third switch module on to output a first level signal received through the first terminal thereof to the second node;

in a threshold voltage compensation phase, turning the third switch module off, turning the first switch module on, and turning the threshold voltage compensation module on, so that a voltage difference between the first node and the second node is a threshold voltage of the driving module;

in a drive gain phase, receiving with the threshold voltage compensation module a data signal of a current frame, converting the data signal of the current frame into a drive gain signal to output to the second node, turning the threshold voltage compensation module off, and turning the first switch module off;

wherein in at least one of the threshold voltage compensation phase and the drive gain phase, the fifth signal source generates the first level signal;

in a light-emitting phase, turning the fourth switch module on to output the first level signal received through the first terminal thereof to the fourth node, so that the second switch module is turned on; the first switch the module is turned on, thus a current corresponding to the drive gain signal is output to the light-emitting element via the first node, the driving module, the third node, and the second switch module.

The technical solutions provided by the embodiments of the present application may have at least the following beneficial effect(s):

1) With the pixel driver circuit, display device, and pixel driving method provided by the embodiments of the application, the threshold voltage of the driving transistor can be effectively compensated, so that the magnitude of the compensated driving current output from the driving transistor to the OLED is irrelevant with the threshold voltage of the driving transistor. The influence by the difference in the threshold voltages of the driving transistors on the display brightness of the OLED can be reduced, so that the display brightness is more stable and uniform, thereby improving the quality of the image displayed.

2) When the pixel driver circuit provided by the embodiments of the present application are in operation, a turning-on level of the driving transistor in the driving module thereof can be increased, and the degree of distortion generated when the signal passes through the driving module can be reduced, thereby ensuring the light-emitting effect.

The additional aspects and advantages of the present application will partly be given in the following description, become obvious from the following description, or be appreciated through the practice of the present application.

DESCRIPTION OF THE DRAWINGS

The above and/or additional aspects and advantages of the present application will become obvious and be readily understood from the following description of the embodiments in conjunction with the accompanying drawings, in which.

DETAILED DESCRIPTION OF EMBODIMENTS

Figure 1:
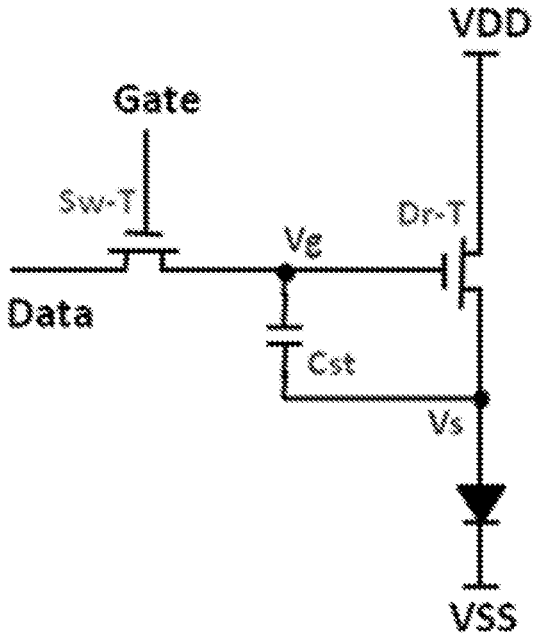
FIG. 1 is a schematic diagram of the circuit principle of a transistor driver circuit in the prior art.

The present application will be described in detail below. Examples of embodiments of the present application are shown in the accompanying drawings, in which the like or similar reference numerals are employed to indicate the like or similar elements or elements with the same or similar functions. In addition, if a detailed description of a known technology is unnecessary for the illustrated features of the present application, it may be omitted. The embodiments described below with reference to the drawings are exemplary, and are only used to explain the present application, and shall not be construed as limitations on the present application.

Those skilled in the art will appreciated that, unless otherwise defined, all terms (including technical terms and scientific terms) used herein have the same meanings as those commonly understood by those of ordinary skills in the art to which the present application belongs. It should also be understood that terms such as those defined in general dictionaries should be understood to have meanings consistent with the meanings in the context of the prior art, and they will not be explained in an idealized or overly formal meaning unless they are specifically defined as such here.

Those skilled in the art will readily understand that, unless specifically stated otherwise, the singular forms "a", "an", "said" and "the" used herein may also include plural forms. It should be further understood that the term "comprising" used in the specification of the present application refers to the presence of the described features, integers, steps, operations, elements, and/or components, but does not exclude the presence or addition of one or more other features, integers, steps, operations, elements, components, and/or groups thereof. The term "and/or" as used herein indicates all or any member(s) of one or more of the associated items and any combinations thereof.

The inventors of the present application have conducted researches and found following issue(s). A basic pixel driver circuit (2T1C) is shown in FIG. 1, in which "Gate" indicates a scanning signal line (also termed as a gate signal line or gate line), and "Data" indicates a data signal line (also termed as data line); "Sw-T" indicates a switching transistor; "Dr-T" indicates a driving TFT (Thin Film Transistor); "Vg" and "Vs" indicate gate voltage and source voltage of Dr-T respectively; "VDD" indicates power supply Voltage; "VSS" indicates ground terminal voltage, and "Cst" indicates a storage capacitor.

The driving current Id flowing through the diode element in FIG. 1 can be expressed as:

$$Id = \frac{1}{2}k(Vgs - Vth)^2 \qquad \text{Expression (1)}$$

In the expression (1), k is a conductivity parameter of the driving TFT, Vgs is the voltage difference between the gate and the source of the driving TFT, and Vth is the threshold voltage of the driving TFT.

It can be seen from the expression (1) that the magnitude of the drive current Id is related to Vth. When the same data signals of the current frame are input to multiple display units in different regions, the drive currents Ids are also unstable in the case that the magnitudes of Vths are unstable. It may cause uneven brightness of the display device.

For addressing the above technical problem(s) in the prior art, the pixel driver circuit, display device, and pixel driving method according to the present application are provided.

The technical solutions of the present application and how the technical solutions of the present application solve the above-mentioned technical problems will be described in detail below with specific embodiments. The following specific embodiments can be combined with each other, and the same or similar elements or processes may not be repeated in some embodiments. The embodiments of the present application will be described below in conjunction with the drawings.

Figure 2:
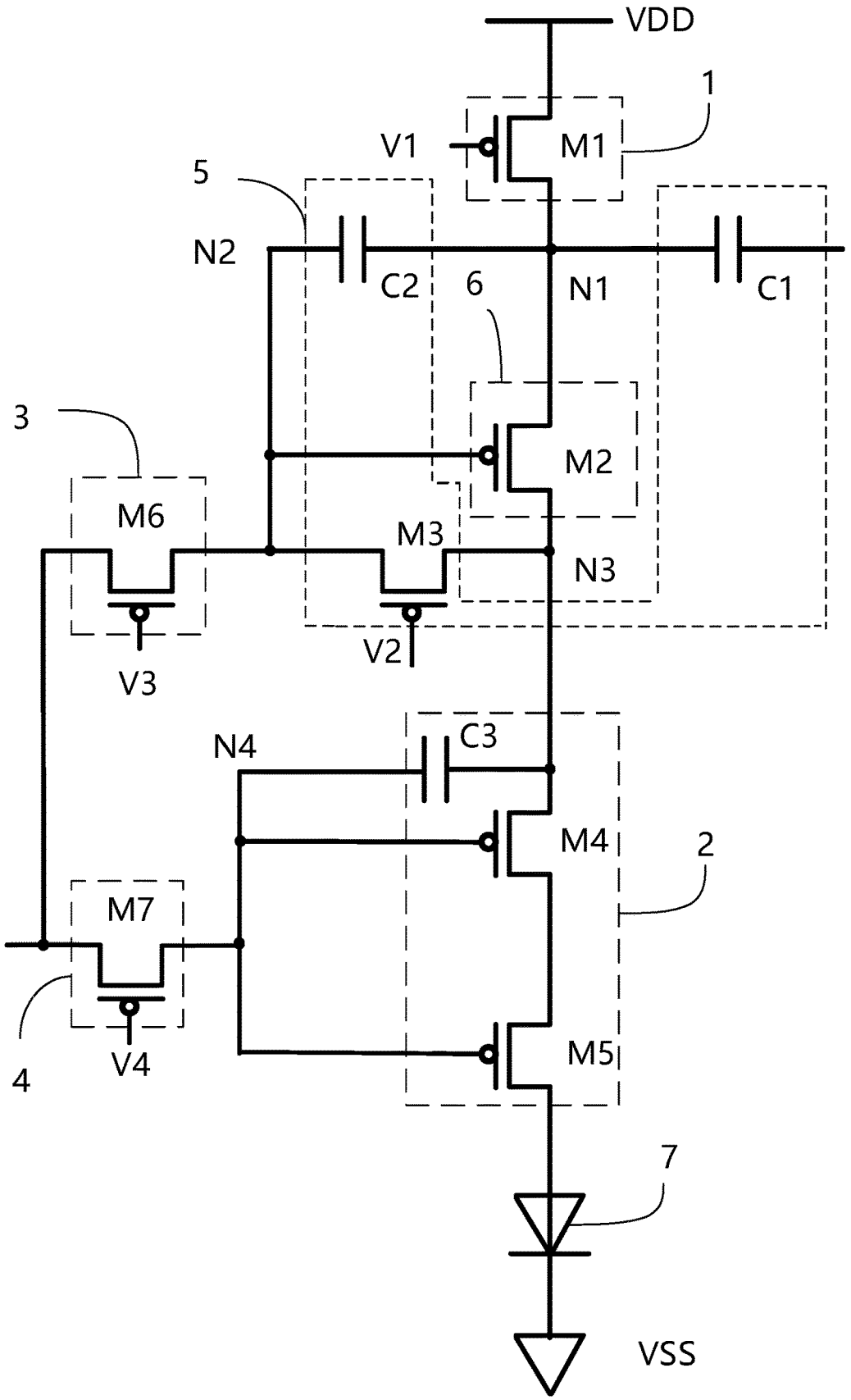
FIG. 2 is a schematic diagram of the circuit principle of a pixel driver circuit according to an embodiment of the application.

A pixel driver circuit is provided according to an embodiment of the present application. As shown in FIG. 2, the pixel driver circuit may include: a threshold voltage compensation module 5, a driving module 6, a first switch module 1, a second switch module 2, and a third switch module 3 and the fourth switch module 4.

First to fifth terminals of the threshold voltage compensation module 5 are electrically connected to a first node N1, a second node N2, a data signal source, a third node N3, and a second signal source, respectively.

First to third terminals of the driving module 6 are electrically connected to the first node N1, the third node N3, and the second node N2, respectively.

First to third terminals of the first switch module 1 are electrically connected to a power supply, the first node N1, and a first signal source, respectively.

First to third terminals of the second switch module 2 are electrically connected to the third node N3, a light emitting element 7, and the fourth node N4, respectively.

First to third terminals of the third switch module 3 are electrically connected to a fifth signal source, the second node N2, and the third signal source, respectively.

First to third terminals of the fourth switch module 4 are electrically connected to the fifth signal source, the fourth node N4, and a fourth signal source, respectively.

Optionally, the threshold voltage compensation module 5 includes a first capacitor C1, a second capacitor C2, and a third transistor M3. One terminal of the first capacitor C1. serves as the third terminal of the threshold voltage compensation module 5 and is electrically connected to the data signal source to receive a data signal Vdata of the current frame from the data signal source. The data signal Vdata may be a pulse signal. The other terminal of the first capacitor C1. and one terminal of the second capacitor C2 collectively serve as the first terminal of the threshold voltage compensation module 5, and the first terminal of the threshold voltage compensation module 5 is electrically connected to the first node N1.

The other terminal of the second capacitor C2 and a second electrode of the third transistor M3 collectively serve as the second terminal of the threshold voltage compensation module 5 and are electrically connected to the second node N2. A first electrode and a control electrode of the third transistor M3 serve as the fourth terminal and the fifth terminal of the threshold voltage compensation module 5, respectively. The fourth terminal of the threshold voltage compensation module 5 is electrically connected to the third node N3. The fifth terminal of the threshold voltage compensation module 5 is electrically connected to the second signal source, and receives a signal V2 from the second signal source. The signal V2 from the second signal source is used to control the turning-off or turning-on of the third transistor M3. The signal V2 from the second signal source may be a pulse signal.

Optionally, the driving module 6 includes a second transistor M2. A first electrode, a second electrode and a control electrode of the second transistor M2 serve as the first terminal, the second terminal and the third terminal of the driving module 6 respectively. The first electrode of the second transistor M2 is electrically connected to the first node N1, the second electrode of the second transistor M2 is electrically connected to the third node N3, and the control electrode of the second transistor M2 is electrically connected to the second node N2.

Optionally, the first switch module 1 includes a first transistor M1. A first electrode, a second electrode and a control electrode of the first transistor M1 serve as the first terminal, the second terminal and the third terminal of the first switch module 1 respectively. The first terminal of the first switch module 1 is electrically connected to the power supply to receive a power supply voltage VDD. The second terminal of the first switch module 1 is electrically connected to the first node N1. The third terminal of the first switch module 1 is electrically connected to the first signal source, and receives a signal V1 from the first signal source. The signal V1 from the first signal source is used to control the turning-off or turning-on of the first transistor M1. The signal V1 from the first signal source may be a pulse signal.

Optionally, the second switch module 2 includes a fourth transistor M4. A first electrode, a second electrode and a control electrode of the fourth transistor M4 serve as the first terminal, the second terminal and the third terminal of the second switch module 2 respectively. The first terminal of the second switch module 2 is electrically connected to the third node N3, the second terminal of the second switch module 2 is electrically connected to the light emitting element 7, and the third terminal of the second switch module 2 is electrically connected to the fourth node N4. The light-emitting element 7 may be an organic light-emitting diode (OLED, Organic Light-Emitting Diode).

Optionally, the second switch module 2 includes the fourth transistor M4 and a third capacitor C3. The first electrode of the fourth transistor M4 and one terminal of the third capacitor C3 jointly serve as the first terminal of the second switch module 2. The second electrode of the fourth transistor M4 serves as the second terminal of the second switch module 2. The control electrode of the fourth transistor M4 and the other terminal of the third capacitor C3 jointly serve as the third terminal of the second switch module 2. The first terminal of the second switch module 2 is electrically connected to the third node N3, the second terminal of the second switch module 2 is electrically connected to the light emitting element 7, and the third terminal of the second switch module 2 is electrically connected to the fourth node N4.

Optionally, the second switch module 2 includes the fourth transistor M4 and a fifth transistor M5. The first electrode of the fourth transistor M4 serves as the first terminal of the second switch module 2, and the second electrode thereof is electrically connected to the first electrode of the fifth transistor M5. The second electrode of the fifth transistor M5 serves as the second terminal of the second switch module 2. The respective control electrodes of the fourth transistor M4 and the fifth transistor M5 collectively serve as the third terminal of the second switch module 2. The first terminal of the second switch module 2 is electrically connected to the third node N3, the second terminal of the second switch module 2 is electrically connected to the light emitting element 7, and the third terminal of the second switch module 2 is electrically connected to the fourth node N4.

In the existing pixel driver circuit, the light-emitting effect of the light-emitting element is mainly controlled by the current corresponding to the data level signal finally received by the light-emitting element. During the light-emitting process of the light-emitting element, the current corresponding to the data level signal flows through multiple transistors, and the turning-on levels of the multiple transistors collectively determines the light-emitting effect of the light-emitting element. Only adjusting the turning-on level of the driving transistor cannot effectively improve the light-emitting effect of the light-emitting element under the control of the pixel driver circuit. The multiple transistors have their own resistances, and the equivalent resistance of the circuit can be reduced by increasing the channel width of the transistors, but this method will cause a risk of leakage currents in the transistors.

In an embodiment of the present application, the fourth transistor M4 and the fifth transistor M5 are connected in series as the second switch module 2 for controlling the current to the light-emitting element 7. During the light-emitting process, the second switch module 2 acts as an equivalent switch corresponding to the light-emitting element 7, and its equivalent channel width is greater than the channel width of the fourth transistor M4 and the channel width of the fifth transistor M5, which can effectively reduce the equivalent resistance of the second switch module 2. Moreover, when the second switch module 2 is in off state, the light-emitting element 7 is disconnected at the fourth transistor M4 and the fifth transistor M5 from other parts of the circuit, which can effectively prevent the generation of leakage current.

Optionally, the second switch module 2 includes a fourth transistor M4, a fifth transistor M5, and a third capacitor C3. The first electrode of the fourth transistor M4 and one terminal of the third capacitor C3 collectively serve as the first terminal of the second switch module 2, and the second electrode of the fourth transistor M4 is electrically connected to the first electrode of the fifth transistor M5. The second electrode of the fifth transistor M5 serves as the second terminal of the second switch module 2. The control electrode of the fourth transistor M4, the control electrode of the fifth transistor M5, and the other terminal of the third capacitor C3 collectively serve as the third terminal of the second switch module 2. The first terminal of the second switch module 2 is electrically connected to the third node N3, the second terminal of the second switch module 2 is electrically connected to the light emitting element 7, and the third terminal of the second switch module 2 is electrically connected to the fourth node N4.

Optionally, the third switch module 3 includes a sixth transistor M6. A first electrode, a second electrode and a control electrode of the sixth transistor M6 serve as the first terminal, the second terminal and the third terminal of the third switch module 3 respectively. The first terminal of the third switch module 3 is electrically connected to the fifth signal source, and receives a signal V5 from the fifth signal source. The second terminal of the third switch module 3 is electrically connected to the second node N2. The third terminal of the third switch module 3 is electrically connected to the third signal source, and receives a signal V3 from the third signal source. The signal V3 from the third signal source is used to control the turning-off or turning-on of the sixth transistor M6. The signal V5 from the fifth signal source and the signal V3 from the third signal source may be pulse signals.

Optionally, the fourth switch module 4 includes a seventh transistor M7. A first electrode, a second electrode and a control electrode of the seventh transistor M7 serve as the first terminal, the second terminal, and the third terminal of the fourth switch module 4, respectively. The first terminal of the fourth switch module 4 is electrically connected to the fifth signal source, and receives the signal V5 from the fifth signal source. The second terminal of the fourth switch module 4 is electrically connected to the fourth node N4. The third terminal of the fourth switch module 4 is electrically connected to the fourth signal source, and receives the signal V4 from the fourth signal source. The signal V4 from the fourth signal source is used to control the turning-off or turning-on of the seventh transistor M7. The signal V4 from the fourth signal source may be a pulse signal.

Figure 3:
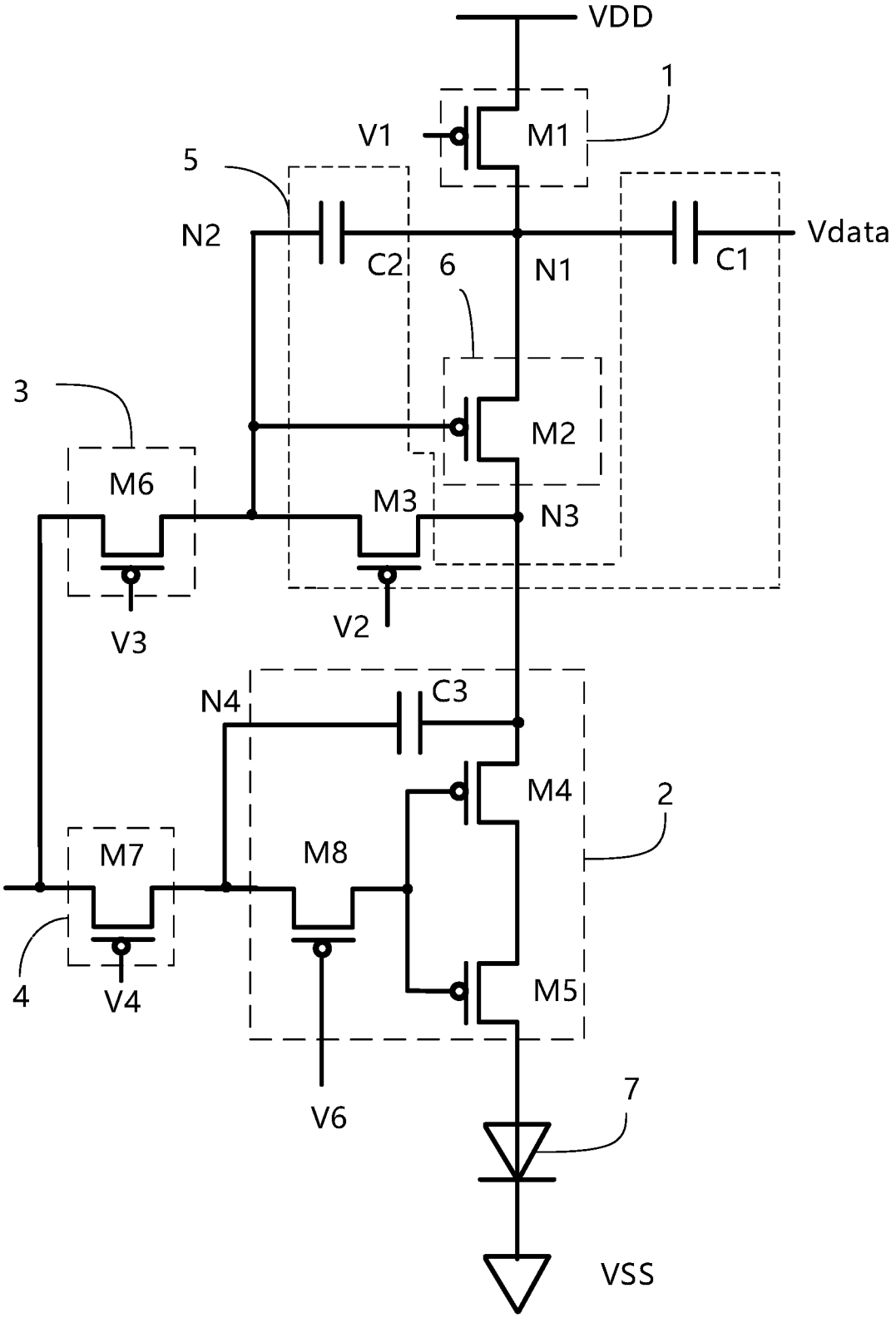
FIG. 3 is a schematic diagram of the circuit principle of another pixel driver circuit according to another embodiment of the application.

Optionally, as shown in FIG. 3, the second switch module 2 includes a fourth transistor M4, a fifth transistor M5, and an eighth transistor M8. The first electrode of the fourth transistor M4 serves as the first terminal of the second switch module 2, and the second electrode is electrically connected to the first electrode of the fifth transistor M5. The second electrode of the fifth transistor M5 serves as the second terminal of the second switch module 2. The respective control electrodes of the fourth transistor M4 and the fifth transistor M5 are electrically connected to the second electrode of the eighth transistor M8, and the first electrode of the eighth transistor M8 serves as the third terminal of the second switch module 2. The first terminal of the second switch module 2 is electrically connected to the third node N3, the second terminal of the second switch module 2 is electrically connected to the light emitting element 7, and the third terminal of the second switch module 2 is electrically connected to the fourth node N4. The control electrode of the eighth transistor M8 is electrically connected to a sixth signal source, and receives a signal V6 from the sixth signal source. The signal V6 of the sixth signal source is used to control the turning-off or turning-on of the eighth transistor M8. The signal V6 from the sixth signal source may be a pulse signal.

Optionally, the second switch module 2 includes a fourth transistor M4, a fifth transistor M5, an eighth transistor M8, and a third capacitor C3. The first terminal of the fourth transistor M4 and the first terminal of the third capacitor C3 are used collectively as the first terminal of the second switch module 2, and the second terminal is electrically connected to the first terminal of the fifth transistor M5. The second electrode of the fifth transistor M5 serves as the second terminal of the second switch module 2. The respective control electrodes of the fourth transistor M4 and the fifth transistor M5 are commonly electrically connected to the second electrode of the eighth transistor M8. The first electrode of the eighth transistor M8 and the other terminal of the third capacitor C3 jointly serve as the third terminal of the second switch module 2. The first terminal of the second switch module 2 is electrically connected to the third node N3, the second terminal of the second switch module 2 is electrically connected to the light emitting element 7, and the third terminal of the second switch module 2 is electrically connected to the fourth node N4. The control electrode of the eighth transistor M8 is electrically connected to the sixth signal source, and receives a signal V6 from the sixth signal source.

Optionally, each of the foregoing transistors is a thin film transistor (TFT), and the control of the transistor is the gate of the thin film transistor. The first electrode of the transistor is the source or drain of the thin film transistor, and the second electrode is the drain or source of the thin film transistor opposite to the first electrode. That is, when the first electrode of the same transistor is the source, the second electrode is drain, and when the first electrode of the same transistor is the drain, the second electrode is the source.

Optionally, each of the above-mentioned transistors may be an N-type MOSFET (Metal-Oxide-Semiconductor Field-Effect Transistor) or a P-type MOSFET. When each transistor is a P-type MOSFET, the thus formed pixel driver circuit is shown in FIG. 2 or FIG. 3.

Figure 4A:
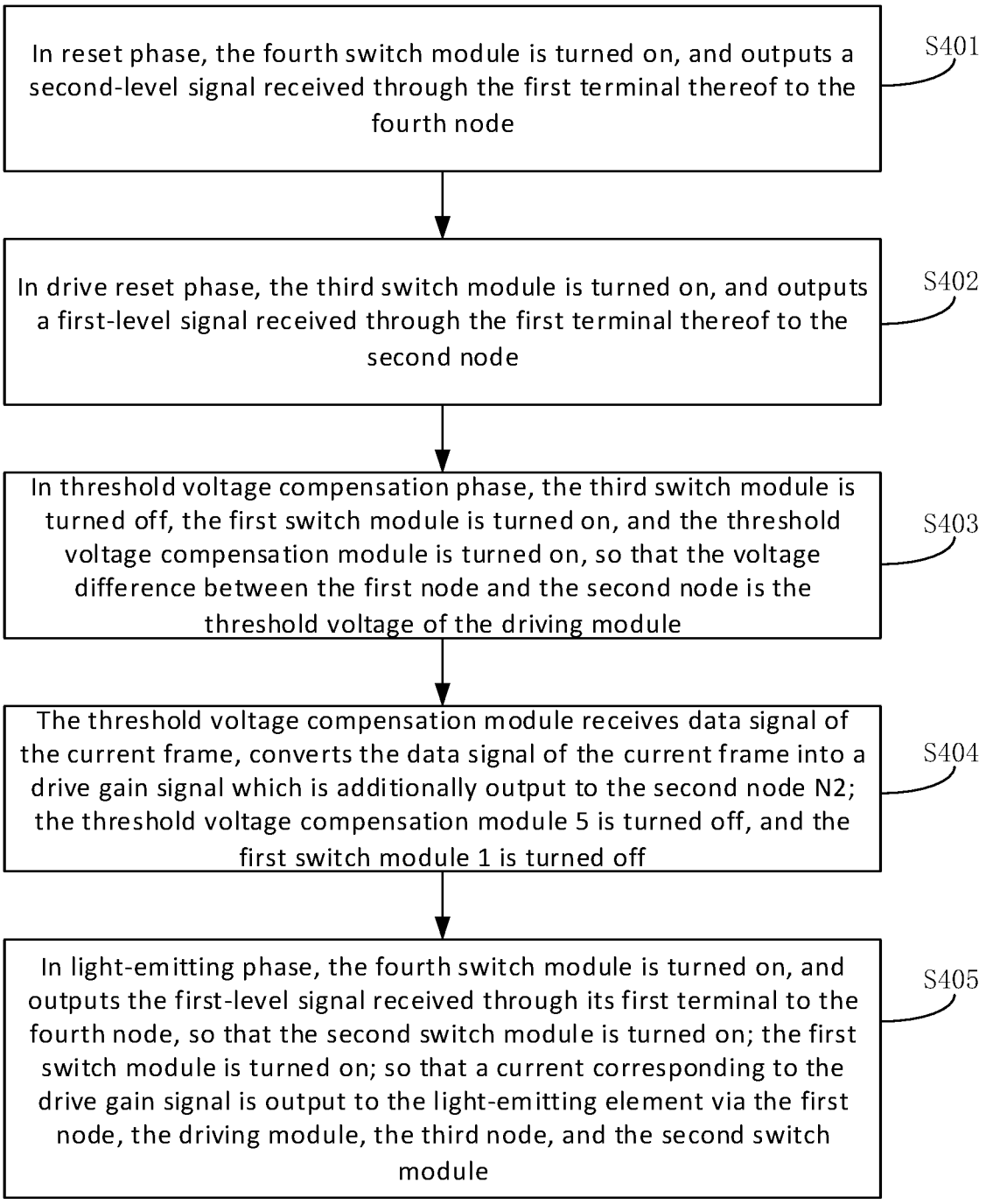
FIG. 4*a* is a schematic flowchart of a pixel driving method according to an embodiment of the application.

Those skilled in the art may readily understand that the circuit connection manner shown in FIG. 2 or FIG. 3 is only used as an example of the pixel driver circuit provided according to the embodiments of the present application. When each transistor is an N-type thin film transistor or the first electrode and the second electrode of each transistor are different electrodes of the thin film transistor, the electrical connection mode of the elements in the pixel driver circuit provided according to the embodiments of the application can be adjusted adaptively, and the electrical connection mode after the adaptive adjustment is still embraced by the disclosure of the application Based on the same inventive concept, according to an embodiment of the application, a pixel driving method is provided, which can be applied to the pixel driver circuits provided in the embodiments of the application. As shown in FIG. 4*a*, the pixel driving method includes:

S401: In a reset phase, the fourth switch module 4 is turned on, and outputs a second level signal received through the first terminal thereof to the fourth node N4.

Optionally, in the reset phase, the fourth switch module 4 is turned on when it receives a first level signal from the fourth signal source through its third terminal, to output the second level signal received through the first terminal of the fourth switch module 4 to the fourth node N4.

S402: In a drive reset phase, the third switch module 3 is turned on, and outputs a first level signal received through the first terminal thereof to the second node N2.

Optionally, in the drive reset phase, the third switch module 3 is turned on when receiving a first level signal of the third signal source through its third terminal, to output the first level signal of the fifth signal source received through the first terminal of the third switch module 3 to the second node N2.

S403: In a threshold voltage compensation phase, the third switch module 3 is turned off, the first switch module 1 is turned on, and the threshold voltage compensation module 5 is turned on, so that the voltage difference between the first node N1 and the second node N2 is the threshold voltage of the driving module 6.

Optionally, in the threshold voltage compensation phase, the third switch module 3 is turned off when receiving the second signal from the third signal source through its third terminal. The first switch module 1 is turned on when receiving the first level signal from the first signal source through its third terminal. The threshold voltage compensation module 5 is turned on when receiving the first level signal from the second signal source through its fifth terminal. As such, the voltage difference between the first node N1 and the second node N2 is the threshold voltage of the driving module.

S404: In a drive gain phase, the threshold voltage compensation module 5 receives data signal of the current frame, converts the data signal of the current frame into a drive gain signal which is additionally output to the second node N2; the threshold voltage compensation module 5 is turned off, and the first switch module 1 is turned off.

Optionally, in the drive gain phase, the threshold voltage compensation module 5 receives the data signal of the current frame from the data signal source through its third terminal, and converts the data signal of the current frame into a drive gain signal to superimpose and output to the second node N2; the threshold voltage compensation module 5 is turned off when receiving a second level signal through its fifth terminal, and the first switch module 1 is turned off when receiving a second level signal through its third terminal.

In at least one of the threshold voltage compensation phase and the drive gain phase, the fifth signal source generates the first level signal.

S405: In a light-emitting phase, the fourth switch module 4 is turned on, and outputs the first level signal received through its first terminal to the fourth node N4, so that the second switch module 2 is turned on; the first switch module 1 is turned on; so that a current corresponding to the drive gain signal is output to the light-emitting element 7 via the first node N1, the driving module 6, the third node N3, and the second switch module 2.

Optionally, in the light-emitting phase, the fourth switch module 4 is turned on, and the first level signal received through the first terminal of the fourth switch module 4 is output to the fourth node N4, so that the second switch module 2 is turned on; the first switch module 1 is turned on when receiving a first level signal through its third terminal; a driving current corresponding to the data level signal in the data signal of the current frame is output to the light emitting element 7 through the first node N1, the driving module 6, and the third node N3, and the second switch module 2.

Figure 4B:
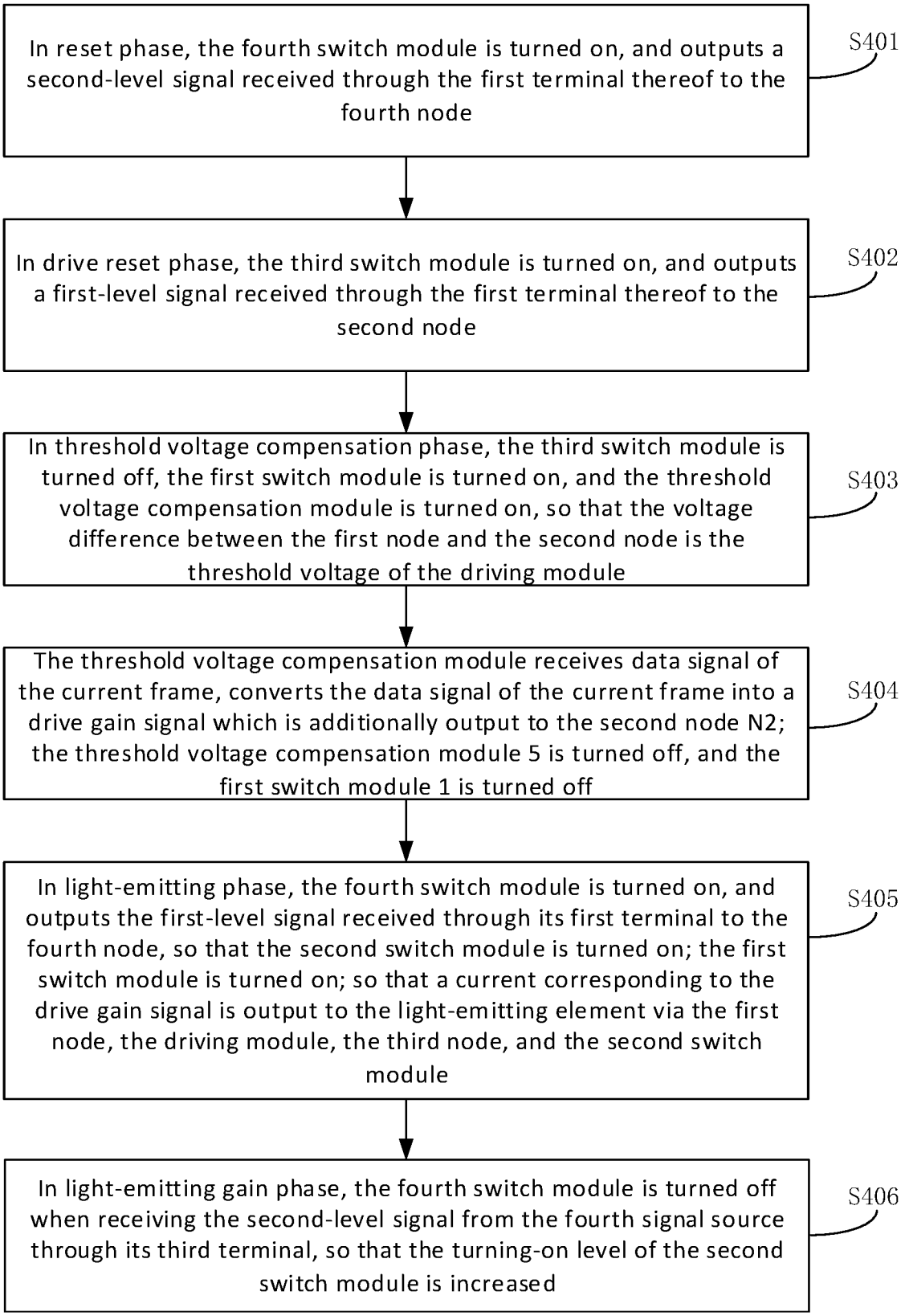
FIG. 4*b* is a schematic flowchart of a pixel driving method according to an embodiment of the application.

Optionally, another pixel driving method is also provided according to the embodiments of the present application, as shown in FIG. 4*b*, and the method further includes step S406 in addition to the above steps S401-S405:

S406: In the light-emitting gain phase, the fourth switch module 4 is turned off when receiving the second level signal from the fourth signal source through its third terminal, so that the turning-on level of the second switch module 2 is increased.

Optionally, the first level signal is a low level signal, and the second level signal is a high level signal. Alternatively, the first level signal is a high level signal, and the second level signal is a low level signal.

The pixel driving methods according to the embodiments of the present application is specifically describe as follows with reference to the pixel driver circuit shown in FIG. 2 and the schematic diagram of the control signals of the pixel driver circuit shown in FIG. 5, and taking the case where the transistors each are P-type thin film transistors as an example.

T1: Reset Phase

Figure 5:
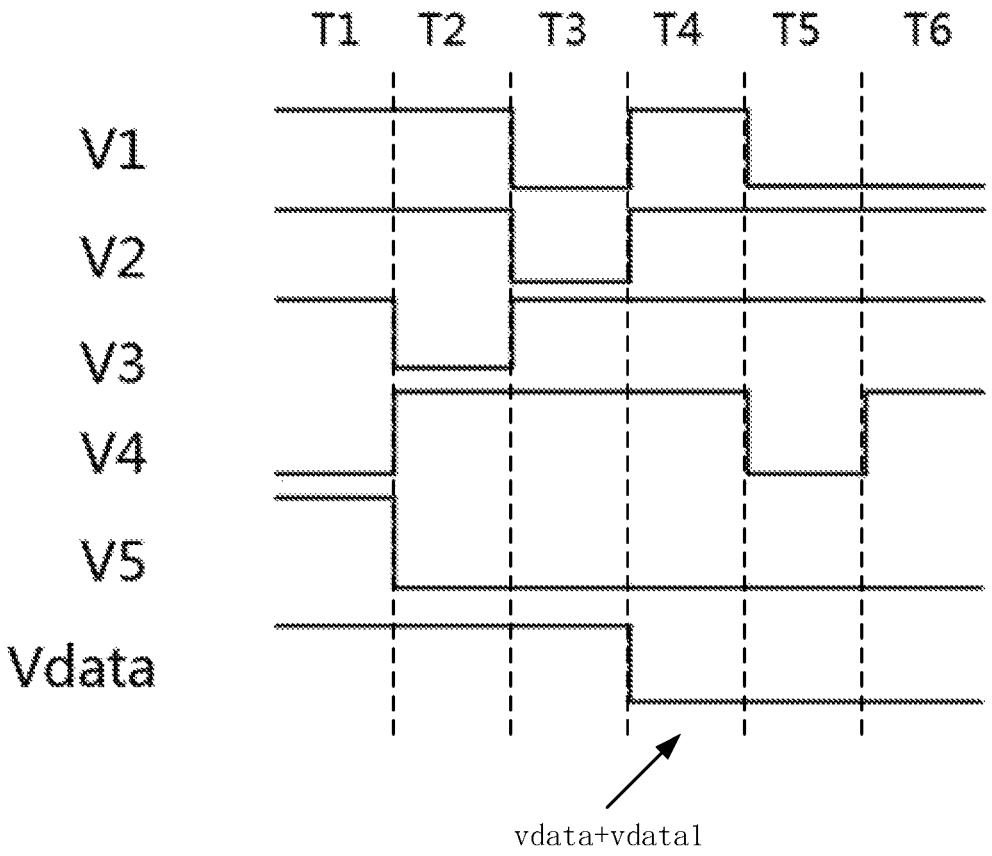
FIG. 5 is a schematic diagram illustrating control signals of a pixel driver circuit according to an embodiment of the application.

In the pixel driver circuit shown in FIG. 2 and the diagram of timing of the signal sources shown in FIG. 5, the signals of the first signal source, the second signal source, the third signal source, the fourth signal source, the fifth signal source and the data signal source are presented as V1, V2, V3, V4, V5, and Vdata. V1, V2, V3, V4, V5, or Vdata may include high-level signal, low-level signal, or other level signal. In this phase, V1, V2, V3, V5 and Vdata are high level signals. V4 is a low-level signal.

V4 at a low level is input by the fourth signal source to the gate of the seventh transistor M7 in the fourth switch module 4. The fourth switch module 4 is turned on when receiving V4 at a low level from the fourth signal source through its third terminal, that is, the seventh transistor M7 is turned on.

V5 at a high level is input by the fifth signal source inputs to the source of the seventh transistor M7, and V5 at the high level is input to the fourth node N4 via the drain of the seventh transistor M7, and the fourth node N4 is set high, so that the fourth transistor M4 and the fifth transistor M5 in the second switch module 2 are turned off, thus, the current flowing to the light-emitting element 7 is blocked and the light-emitting element 7 is reset.

T2: Drive Reset Phase

In this phase, the first signal source, the second signal source, and the data signal source maintain the logic high level of the previous phase, and output signals V1, V2, and Vdata at high levels, respectively. The third signal source and the fifth signal source are adjusted from a logic high potential to a logic low potential, and respectively output signals V3 and V5 at a low level. The fourth signal source is adjusted from a logic low level to a logic high level, and outputs a signal V4 at a high level. In this phase, V1, V2, V4, and Vdata are high-level signals, and V3 and V5 are low-level signals.

The fourth switch module 4 is turned off when the gate of the fourth signal source receives the signal V4 at the high level, and disconnects the connection between the fifth signal source and the second switch module 2.

The sixth transistor M6 in the third switch module 3 is turned on when its gate receives the signal V3 of the third signal source at the low level. The signal V5 of the fifth signal source at the low level is output to the source of the sixth transistor M6. The sixth transistor M6 inputs the low-level signal V5 to the second node N2 through its drain, sets the level of the second node N2 low, and then resets the second transistor M2 which functions as a driving transistor.

T3: Threshold Voltage Compensation Phase

In this phase, the fourth signal source and the data signal source maintain the logic high potential of the previous phase, and respectively output signals V4 and Vdata at high levels. The fifth signal source maintains the logic low level of the previous phase and outputs a signal V5 at a low level. The first signal source and the second signal source are adjusted from a logic high potential to a logic low potential, and respectively output signals V1 and V2 at a low level. The third signal source is adjusted from a logic low level to a logic high level, and outputs a signal V3 at a high level. In this phase, V3, V4, and Vdata are high-level signals, and V1, V2, and V5 are low-level signals.

The first transistor M1 of the first switch module 1 is turned on when receiving the low-level signal V1 of the first signal source through the gate of M1, and the power supply voltage VDD is output to the source of the first transistor M1. The first transistor M1 inputs the power supply voltage VDD to the first node N1 through its drain.

The third transistor M3 in the threshold voltage compensation module 5 is turned on when it receives a low-level signal V2 from the second signal source through the gate of M3. At this time, M3 functions similarly to a wire, and the second transistor M2 is in an ON state, the voltage VDD of the first node N1 is output to the source of the second transistor M2, the source of M2 outputs a current to the third node N3 where the drain of M2 is located, and the third transistor M3 is turned on at this time and functions equivalent to a wire to output the drain voltage of M2 from the third node N3 to the second node N2. Since the gate of the second transistor M2 is electrically connected to the source of M2 through the capacitor C2, that is, M2 is connected in a source-follower mode, the source of the second transistor M2 outputs a current to the drain until the gate voltage of M2 (i.e., the voltage at the second node N2) $V_{N2-T3}$ satisfies the following expression (2):

$$V_{N2-T3}=VDD+Vth \quad \text{Expression (2)}$$

In the expression (2), VDD is the source voltage of M2, the value of which at this time is equal to the power supply voltage, and Vth is the threshold voltage of the second transistor M2. Vth<0.

At this time, the voltages of the second node N2 and the third node N3 are equal, and the values can be expressed by the above expression (2); the voltage difference between the first node N1 and the second node N2 is the threshold voltage Vth of the second transistor M2. That is, the value of the voltage difference between the gate and source of the second transistor M2 is the threshold voltage Vth of the second transistor M2.

In phases T1 to T3, the data signal source continuously outputs the first level signal vdata.

In the phases T1-T3, the fourth transistor M4 and the fifth transistor M5 connected in series are kept in OFF state, which can reduce the leakage current of M2.

T4: Drive Gain Phase

In this phase, the third signal source and the fourth signal source maintain the logic high potential of the previous phase, and output signals V3 and V4 at high levels, respectively. The fifth signal source maintains the logic low level of the previous phase, and outputs a signal V5 at a low level. The first signal source and the second signal source are adjusted from a logic low potential to a logic high potential, and respectively output signals V1 and V2 at a high level. The data signal source is adjusted from a logic high level to output the data signal of current frame. In this phase, V1, V2, V3, and V4 are high-level signals, and V5 is low-level signals. Compared with the logic high potential, data signal of the current frame is closer to the logic low potential.

The first transistor M1 of the first switch module 1 is turned off when receiving the signal V1 at high-level of the first signal source through the gate of M1, and disconnects the electrical connection between the power supply and the first node N1.

The third transistor M3 of the threshold voltage compensation module 5 is turned off when receiving the signal V2 at high-level of the second signal source through the gate of M3, and disconnects the electrical connection between the third node N3 and the second node N2. Under the action of capacitive coupling, the voltage $V_{N2-T4}$ of the second node N2 is adjusted to:

$$V_{N2-T4}=VDD+Vth+\text{vdata1}*c1/(c1+c2) \quad \text{Expression (3)}$$

$$V_{data}=T_4=\text{vdata}+\text{vdata1} \quad \text{Expression (4)}$$

In expressions (3) and (4), (vdata+vdata1) is the data signal of the current frame generated by the data signal source, vdata is the value of the first level signal in the data signal of the current frame, and vdata1 is the value of the data level signal of the data signal of the current frame. The value vdata1 of the data level signal is the difference between the data signal of the current frame of the data signal Vdata in the current phase (T4) and the first level signal of the previous phase (T3). vdata1<0. c1 is the capacitance value of the first capacitor C1. c2 is the capacitance value of the second capacitor C2.

It can be seen that if the voltage of the second node N2 in the drive gain phase is lower than the voltage of the second node N2 in the threshold voltage compensation phase, the turning-on level of the second transistor M2 is increased, and the loss generated when the current frame data signal passes through the second transistor M2 is less, which is beneficial to improve the light-emitting effect of the light-emitting element 7 in the next phase.

T5: Light-Emitting Phase

In this phase, the second signal source and the third signal source maintain the logic high level of the previous phase, and respectively output signals V2 and V3 at high levels. The fifth signal source maintains the logic low level of the previous phase, and outputs a signal V5 at a low level. The data signal source continuously outputs the current frame data signal (vdata+vdata1) of the previous phase. The first signal source and the fourth signal source are adjusted from a logic high potential to a logic low potential, and respectively output signals V1 and V4 at a low level. In this phase, V2 and V3 are high-level signals, and V1, V4, and V5 are low-level signals.

The seventh transistor M7 of the fourth switch module 4 is turned on when receiving the signal V4 of the fourth signal source at a low level through the gate of M7, so that the I signal V5 of the fifth signal source at a low level is input to the fourth node N4. The voltage level of the fourth node N4 is set low, and the fourth transistor M4 and the fifth transistor M5 of the second switch module 2 are turned on.

The first transistor M1 of the first switch module 1 is turned on when receiving the signal V1 of the first signal source at a low level through the gate of M1. At this time, the source voltage of the second transistor M2 which is the driving transistor is VDD, and the voltage at the second node N2 (i.e., the gate voltage of M2) is still [VDD+Vth+vdata1*c1/(c1+c2)], then the gate-source voltage difference of M2 is [Vth+vdata1*c1/(c1+c2)], so that the value of the gate-source voltage difference of M2 minus the threshold voltage of M2 is vdata1*c1/(c1+c2), which is the equivalent gate-source voltage difference or a drive gain signal for M2. It can be seen that the drive gain signal vdata1*c1/(c1+c2) of M2 is not relevant with the threshold voltage Vth of M2.

M2 delivers the driving current under the action of the drive gain signal. The driving current corresponding to the drive gain signal is output to the light-emitting element 7 through the first node N1, the driving module 6, the third node N3, and the second switch module 2, so that the light-emitting element 7 emits light.

The above-mentioned phases T1 to T5 correspond to the circuit principles of the pixel driver circuit in a period for the light-emitting element to emit light. In phases T3 to T5, the fifth signal source is at a logic low level. In an alternative embodiment, in the T3 phase, the fifth signal source is at a logic high level; in the T4 phase, the fifth signal source is adjusted from a logic high level to a logic low level, and in the T5 phase the fifth signal source maintains the logic low level of the previous phase. In another alternative embodiment, in the T3 and T4 phases, the fifth signal source is at a logic high level; and in the T5 phase the fifth signal source is adjusted from a logic high level to a logic low level.

In an optional embodiment of the present application, during a period for light emission (that is, one frame) of the light-emitting element, the operation phases experienced by the pixel driver circuit may further include a light-emitting gain phase T6. The light-emitting gain phase T6 is carried out after the light-emitting phase T5.

T6: Light-emitting gain phase In this phase, the second signal source and the third signal source maintain the logic high level of the previous phase, and respectively output signals V2 and V3 at high levels. The first signal source maintains the logic low level of the previous phase, and outputs the signal V1 at the low level. The data signal source continuously outputs the current frame data signal (vdata+vdata1) of the previous phase, and the fourth signal source is adjusted from the logic low level of the previous phase to the logic high level, and outputs the signal V4 at the high level. The signal output of the fifth signal source shall not be limited thereto, it can maintain the logic low level of the previous phase and output the signal V5 at the low level. In this phase, V2, V3, and V4 are high-level signals, and V1 is a low-level signal.

The seventh transistor M7 is turned off when receiving the high-level signal V4 of the fourth signal source through its third terminal, and disconnects the connection between the fifth signal source and the second switch module 2, so that the fourth node N4 remains at a low level. The serially-connected M4 and M5 maintain to conduct, and the conduction current thereof gradually increases and tends to be saturate. The level of the third node N3 electrically connected to the source of M4 is pulled down. Under the action of the capacitor C3, the potential at the fourth node N4 to which the gates of M4 and M5 are electrically connected is continuously pulled down. The turning-on levels of the fourth transistor M4 and the fifth transistor M5 are increased, the loss when the current corresponding to the drive gain signal flows through M4 and M5 is reduced, and the light-emitting effect of the light-emitting element 7 is improved.

In an optional embodiment of the present application, the pixel driver circuit has a structure as shown in FIG. 3. The second switch module 2 includes a fourth transistor M4, a fifth transistor M5, an eighth transistor M8, and a third capacitor C3. The respective gates of the fourth transistor M4 and the fifth transistor M5 are commonly connected to the drain of the eighth transistor M8. One terminal of the third capacitor C3 and the source of the fourth transistor M4 are commonly connected to the third node N3, and the other terminal of the third capacitor C3 and the source of the eighth transistor M8 are commonly connected to the drain of the seventh transistor M7 of the fourth switch module 4.

When the pixel driver circuit as shown in FIG. 3 is in operation, in one period for the light-emitting element to emit light, the pixel driver circuit goes through the following operation phases.

T1: Reset Phase

In this phase, the sixth signal source is at a logic low level and outputs signal V6. In this phase, the signal V6 is a low level signal. The states of other signal sources are consistent with the states of the respective signal sources in the reset phase T1 in the above embodiment.

The sixth signal source outputs the signal V6 at a low level to the gate of the eighth transistor M8, and the eighth transistor M8 is turned on. The high level signal at the fourth node N4 is input to the gates of the fourth transistor M4 and the fifth transistor M5. The fourth transistor M4 and the fifth transistor M5 are turned off.

T2: Drive Reset Phase

In this phase, the sixth signal source is at a logic high level and outputs signal V6. In this phase, the signal V6 is a high-level signal. The states of other signal sources are consistent with the states of the respective signal sources in the drive reset phase T2 in the above embodiment.

The sixth signal source outputs the high-level signal V6 to the gate of the eighth transistor M8, the eighth transistor M8 is turned off, and the respective gates of the fourth transistor M4 and the fifth transistor M5 are disconnected from the fourth node N4; the fourth node N4 remains at high level, and the fourth transistor M4 and the fifth transistor M5 are in the OFF state.

T3: Threshold Voltage Compensation Phase

In this phase, the sixth signal source continues the logic high level of the previous phase, and outputs the signal V6 at the high level. The states of the other signal sources are consistent with the states of the respective signal sources in the threshold voltage compensation phase T3 in the foregoing embodiment.

T4-1: Drive Gain Phase

In this phase, the sixth signal source continues the logic high level of the previous phase, and outputs the signal V6 at the high level. The states of the other signal sources are consistent with the states of the respective signal sources in the drive gain phase T4 in the above embodiment.

T4-2: Light-Emitting Preparation Phase

In this phase, the second signal source, the third signal source, and the sixth signal source continue to maintain the logic high levels as the previous phase, and output signals V2, V3, and V6, respectively. The fifth signal source maintains the logic low level as the previous phase and outputs a signal V5. The data signal source continuously outputs the current frame data signal of the previous phase. The first signal source and the fourth signal source are adjusted from a logic high level to a logic low level, and output signals V1 and V4, respectively. In this phase, V2, V3, and V6 are high-level signals, and V1, V4, and V5 are low-level signals.

The gate of the seventh transistor M7 of the fourth switch module 4 is turned on when receiving the signal V4 of the fourth signal source at a low level, so that the low-level signal of the fifth signal source is input to the fourth node N4, and the level at the fourth node N4 is set low.

The gate of the first transistor M1 of the first switch module 1 is turned on when it receives the signal V1 at the low level from the first signal source. The eighth transistor M8 is in the OFF state under the control of the signal V6 at high level, and the gates of the fourth transistor M4 and the fifth transistor M5 maintain the high level of the previous phase and are in OFF state.

T5: Light-Emitting and Gain Phase

In this phase, the fourth signal source is adjusted from a logic low level to a logic high level, and a signal V4 is output. The sixth signal source is adjusted from a logic high level to a logic low level, and outputs a signal V6. The states of other signal sources remain unchanged from the previous phase. In this phase, V4 is a high-level signal, and V6 is a low-level signal. In this phase, the data signal source continues to output the current frame data signal (vdata+vdata1) of the previous phase. The signal output of the fifth signal source shall not be limited thereto, and it can maintain the logic low level of the previous phase and output the signal V5 at the low level.

The seventh transistor M7 of the fourth switch module 4 is turned off when it receives the signal V4 of the fourth signal source at high level through the gate of M7, and disconnects the connection between the fifth signal source and the fourth node N4, so that the fourth node N4 maintains a low level. The eighth transistor M8 is turned on when receiving the signal V6 of the sixth signal source at low level through the gate of M8, and outputs the low-level signal of the fourth node N4 to the gates of the fourth transistor M4 and the fifth transistor M5 so that the fourth transistor M4 and the fifth transistor M5 are turned on.

M4 and M5 connected in series continue to be conductive, the conduction current gradually increases and tends to be saturated, the level of the third node N3 electrically connected to the source of M4 is pulled down, and under the action of the capacitor C3, the level of the fourth node N4 which is electrically connected to the source of M8 continues to be gradually pulled down, so that the levels of the drain of M8 and the gates of M4 and M5 that are electrically connected to the drain of M8 are all pulled down, so that the turning-on levels of the fourth transistor M4 and the fifth transistor M5 are increased, the loss when the current corresponding to the drive gain signal flows through M4 and M5 is reduced, and the light-emitting effect of the light-emitting element 7 is improved.

The above-mentioned phases T1 to T5 correspond to the circuit principles of the pixel driver circuit during one I period for the light-emitting element to emit light. In phases T3 to T5, the fifth signal source is at a logic low level. In an alternative embodiment, in the T3 phase, the fifth signal source is at a logic high level; in the T4-1 phase the fifth signal source is adjusted from a logic high level to a logic low level, and in the T4-2 and T5 phases the fifth signal source maintains at the logic low level as the previous phase. In another alternative embodiment, in phase T4-2 the fifth signal source is adjusted from a logic high level to a logic low level, and the fifth signal source in phase T5 maintains the logic low level as in the previous phase. In another alternative embodiment, in the T3, T4-1 and T4-2 phases, the fifth signal source is at a logic high level; and in the T5 phase the fifth signal source is adjusted from a logic high level to a logic low level.

with the pixel driver circuits and pixel driving methods according to the embodiments of the present application, at least the following beneficial effect(s) can be achieved.

1) With the pixel driver circuits, display devices, and pixel driving methods according to the embodiments of the present application, the threshold voltage of the driving transistor can be effectively compensated, so that the driving current output from the driving transistor to the OLED after being compensated is irrelevant with the threshold voltage of the driving transistor. The influence of the threshold voltage of the driving transistor on the display brightness can be reduced, the display brightness can be more stable, and the uniformity of the display can be improved, thereby improving the quality of the display picture.

2) When the pixel driver circuits according to the embodiments of the present application are in operation, the turning-on level of the driving transistor in the driving module can be increased, and the degree of signal distortion generated when the signal passes through the driving module can be reduced, thereby ensuring the light-emitting effect.

Based on the same inventive concept, according to an embodiment of the present application a display device is provided, which includes the pixel driver circuit according to the embodiments of the present application.

According to the embodiments of the application, a display device is also provided that has the same inventive concept and the same beneficial effects as the previous embodiments. For the content not shown or described in connection with the display device in detail, please refer to the previous embodiments, and detailed descriptions thereof are omitted here.

Those skilled in the art can readily understand that the various operations, methods, steps in a process, measures, and solutions that have been discussed in the present application can be alternated, changed, combined, or omitted. Further, various operations, methods, and other steps in the process, measures, and solutions that have been discussed in the present application can also be alternated, changed, rearranged, decomposed, combined, or omitted. Further, the various operations, methods, steps in a process, measures, and solutions in the prior art that have been discussed disclosed in the present application can also be alternated, changed, rearranged, decomposed, combined or deleted.

The terms "first" and "second" are only used for descriptive purposes, and shall not be construed as indicating or implying relative importance or implicitly indicating the number of the indicated technical features. Thus, a feature defined with "first" or "second" may explicitly or implicitly include one or more of the features. In the description of the present invention, unless otherwise specified, "plurality" means two or more.

It should be understood that, although the various steps in the flowchart of the drawings are shown in sequence as indicated by the arrows, these steps are not intended to be necessarily executed in sequence in the order indicated by the arrows. Unless explicitly stated in this article, the execution of these steps is not strictly limited in order, and they can be executed in other orders. Moreover, at least part of the steps in the flowchart of the drawings may include multiple sub-steps or multiple phases. These sub-steps or phases are not necessarily executed at the same time, instead can be executed at different times, and the order of execution is also not necessarily performed sequentially, but may be performed in turn or alternately with other steps or at least a part of sub-steps or phases of other steps.

The above are only parts of the implementations of the present application. It should be understood that for those of ordinary skills in the art, various changes and modifications can be made without departing from the principle of the present application, and these changes and modifications are intended to be embraced by the protection scope of the present application.

What is claimed is:

1. A pixel driver circuit, comprising:

a first switch circuit including a first transistor;

a driving circuit including a second transistor for providing a drive current to a pixel;

a threshold voltage compensation circuit including a first capacitor, a second capacitor and a third transistor, and for providing threshold voltage compensation for the driving circuit;

a second switch circuit including a transistor;

a third switch circuit including a transistor; and a fourth switch circuit including a transistor, wherein first to fifth terminals of the threshold voltage compensation circuit are electrically connected to a first node, a second node, a first signal source, a third node, and a second signal source, respectively, and wherein an terminal of the first capacitor is coupled to the third terminal of the threshold voltage compensation circuit, the other terminal of the first capacitor and one terminal of the second capacitor collectively are coupled to the first terminal of the threshold voltage compensation circuit, the other terminal of the second capacitor and a second electrode of the third transistor collectively are coupled to the second terminal of the threshold voltage compensation circuit, and a first electrode and a control electrode of the third transistor respectively are coupled to the fourth terminal and the fifth terminal of the threshold voltage compensation circuit;

wherein first to third terminals of the driving circuit are electrically connected to the first node, the third node, and the second node, respectively, and wherein a first electrode, a second electrode and a control electrode of the second transistor respectively are coupled to the first terminal, the second terminal and the third terminal of the driving circuit;

wherein first to third terminals of the first switch circuit are electrically connected to a power supply, the first node, and the first signal source, respectively, and wherein a first electrode, a second electrode and a control electrode of the first transistor respectively are coupled to the first terminal, the second terminal and the third terminal of the first switch circuit;

wherein first to third terminals of the second switch circuit are electrically connected to the third node, a light emitting element, and a fourth node, respectively, and wherein a first electrode of the transistor of the second switch circuit is coupled to the first terminal of the second switch circuit, and wherein a control electrode of the transistor of the second switch circuit is coupled to the third terminal of the second switch circuit;

wherein first to third terminals of the third switch circuit are electrically connected to a fifth signal source, the second node, and a third signal source, respectively, and wherein a first electrode, a second electrode and a control electrode of the sixth transistor respectively are coupled to the first terminal, the second terminal and the third terminal of the third switch circuit;

wherein first to third terminals of the fourth switch circuit are electrically connected to the fifth signal source, the fourth node, and a fourth signal source, respectively, and wherein a first electrode, a second electrode and a control electrode of the seventh transistor respectively are coupled to the first terminal, the second terminal and the third terminal of the fourth switch circuit.

2. The pixel driver circuit according to claim 1, wherein the second switch circuit further includes an additional transistor, wherein a second electrode of the transistor is electrically connected to a first electrode of the additional transistor, wherein a second electrode of the additional transistor is coupled to the second terminal of the second switch circuit, and wherein a control electrode of the additional transistor collectively is coupled to the third terminal of the second switch circuit.

3. The pixel driver circuit of claim 2, wherein the second switch circuit further includes a third capacitor, wherein:

a terminal of the third capacitor is coupled to the first terminal of the second switch circuit, and the other terminal of the third capacitor is coupled to the third terminal of the second switch circuit.

4. The pixel driver circuit according to claim 2, wherein the second switch circuit further comprises an eighth transistor, wherein a first electrode, a second electrode and a control electrode of the eighth transistor are respectively coupled to the control electrodes of the transistor and the additional transistor of the second switch circuit, the fourth node, and a signal source (V6).

5. A display device comprising the pixel driver circuit according to claim 1.

6. A pixel driving method for the pixel driver circuit according to claim 1, comprising:

in a reset phase, turning the fourth switch circuit on to output a second level signal received through the first terminal thereof to the fourth node;

in a drive reset phase, turning the third switch circuit on to output a first level signal received through the first terminal thereof to the second node;

in a threshold voltage compensation phase, turning the third switch circuit off, turning the first switch circuit on, and turning the threshold voltage compensation circuit on, so that a voltage difference between the first node and the second node is a threshold voltage of the driving circuit;

in a drive gain phase, receiving with the threshold voltage compensation circuit a data signal of a current frame, converting the data signal of the current frame into a drive gain signal to be superimposed and output to the second node, turning the threshold voltage compensation circuit off, and turning the first switch circuit off;

wherein in at least one of the threshold voltage compensation phase and the drive gain phase, the fifth signal source generates the first level signal;

in a light-emitting phase, turning the fourth switch circuit on to output the first level signal received through the first terminal thereof to the fourth node, so that the second switch circuit is turned on; turning the first switch the circuit on, thus a current corresponding to the drive gain signal is output to the light-emitting element via the first node, the driving circuit, the third node, and the second switch circuit.

7. The pixel driving method according to claim 6, after the light-emitting phase, further comprising:

in a light-emitting gain phase, turning the fourth switch circuit off when the second level signal from the fourth signal source is received through the third terminal thereof, so that a turning-on level of the second switch circuit is increased.

8. The pixel driving method according to claim 6, wherein the first level signal is at a level lower than the second level signal.

* * * * *